US009389028B2

(12) United States Patent
Dahlberg

(10) Patent No.: US 9,389,028 B2
(45) Date of Patent: Jul. 12, 2016

(54) PLATE HEAT EXCHANGER

(75) Inventor: Tomas Dahlberg, Helsingborg (SE)

(73) Assignee: SWEP International AB, Landskrona (SE)

( * ) Notice: Subject to any disclaimer, the term of this patent is extended or adjusted under 35 U.S.C. 154(b) by 221 days.

(21) Appl. No.: 13/808,780

(22) PCT Filed: Jun. 15, 2011

(86) PCT No.: PCT/EP2011/059965

§ 371 (c)(1), (2), (4) Date: Mar. 25, 2013

(87) PCT Pub. No.: WO2012/004100

PCT Pub. Date: Jan. 12, 2012

(65) Prior Publication Data

US 2013/0180699 A1 Jul. 18, 2013

(30) Foreign Application Priority Data

Jul. 8, 2010 (SE) ..... 1050755

(51) Int. Cl.
*F28F 3/02* (2006.01)
*F28F 3/04* (2006.01)
(Continued)

(52) U.S. Cl.
CPC ..... *F28F 3/08* (2013.01); *F28D 9/0031* (2013.01); *F28F 3/046* (2013.01)

(58) Field of Classification Search
CPC ..... F28D 9/00; F28D 9/0025; F28D 9/0031; F28D 9/0037; F28F 3/02; F28F 3/04; F28F 3/042; F28F 3/044; F28F 3/046
USPC ..... 165/166, 167
See application file for complete search history.

(56) References Cited

U.S. PATENT DOCUMENTS 3,469,626 A * 9/1969 Wilson ..... F28F 3/046 165/166
3,661,203 A * 5/1972 Mesher ..... 165/167
(Continued)

FOREIGN PATENT DOCUMENTS

CN 2119632 10/1992
DE 10 2008 014 375 9/2009
(Continued)

OTHER PUBLICATIONS

Chinese Office Action for application No. 201180033465.1 mailed Aug. 7, 2014 (8 pages).
(Continued)

*Primary Examiner* — Allen Flanigan
*Assistant Examiner* — For K Ling
(74) *Attorney, Agent, or Firm* — Merchant & Gould P.C.

(57) ABSTRACT

A plate heat exchanger for exchanging heat between media-comprises a number of stacked plates (A, B, C, D), the plates being provided with a first, large scale pressed pattern comprising ridges (R) and grooves (G) intended to keep first (A, B) and second (B,C) pairs of stacked plates on a distance from one another, such that flow channels for a first medium is formed in spaces between said plate pairs. Contact points are provided between the plate pairs in points where the large scale pressed pattern of neighboring plate pairs contact one another. The plates of each plate pair (A, B; C, D) are kept on a distance from one another by a small-scale pressed pattern comprising ridges (r) and grooves (g).

4 Claims, 2 Drawing Sheets

(51) Int. Cl.
*F28D 9/00* (2006.01)
*F28F 3/08* (2006.01)

(56) References Cited

U.S. PATENT DOCUMENTS

| | | | | | |
|---|---|---|---|---|---|
| 4,911,235 | A | * | 3/1990 | Andersson et al. | 165/167 |
| 5,467,817 | A | * | 11/1995 | Schwald | 165/167 |
| 5,638,899 | A | * | 6/1997 | Blomgren et al. | 165/166 |
| 5,806,584 | A | * | 9/1998 | Thonon et al. | 165/166 |
| 6,016,865 | A | * | 1/2000 | Blomgren | 165/148 |
| 8,104,531 | B2 | * | 1/2012 | Tochon et al. | 165/11.1 |
| 2008/0029257 | A1 | * | 2/2008 | Nilsson | 165/167 |
| 2011/0139419 | A1 | * | 6/2011 | Blomgren et al. | 165/170 |

FOREIGN PATENT DOCUMENTS

| | | | | |
|---|---|---|---|---|
| EP | 1 394 491 | | | 3/2004 |
| JP | 11173771 | A | * | 7/1999 |
| JP | 11281283 | A | * | 10/1999 |

OTHER PUBLICATIONS

International Search Report for International Application No. PCT/EP2011/059965 mailed Sep. 30, 2011.

International Written Opinion for International Application No. PCT/EP2011/059965.

* cited by examiner

PLATE HEAT EXCHANGER

This application is a National Stage Application of PCT/EP2011/059965, filed 15 Jun. 2011, which claims benefit of Ser. No. 1050755-6, filed 8 Jul. 2010 in Sweden and which applications are incorporated herein by reference. To the extent appropriate, a claim of priority is made to each of the above disclosed applications.

FIELD OF THE INVENTION

The present invention relates to a plate heat exchanger for exchanging heat between media, the heat exchanger comprising a number of stacked plates, the plates being provided with a first, large scale pressed pattern comprising ridges and grooves intended to keep first and second pairs of stacked plates on a distance from one another, such that flow channels for a first medium is formed in spaces between said plate pairs, and to provide contact points between the plate pairs in points where the large scale pressed pattern of neighboring plate pairs contact one another.

PRIOR ART

Heat exchangers are widely used for a variety of applications where two media are to exchange heat with one another.

Plate heat exchangers, especially brazed plate heat exchangers, have over the years proven to be the most efficient and economical solutions for most applications. As well known by persons skilled in the art, a brazed plate heat exchanger comprises a number of heat exchanger plates provided with a pressed pattern of ridges and grooves adapted to provide contact points between the plates, hence keeping neighboring plates on a distance from one another under formation of interplate flow channels. Neighboring plates are brazed to one another at the contact points. Most brazed plate heat exchangers are "symmetric", i.e. they have the same flow resistance for equal mass flow for all interplate flow channels.

Moreover, plate heat exchangers are not known to withstand high pressure; most heat exchangers have a design burst pressure of twenty or thirty bars. This is sufficient for most applications, even for use in refrigeration circuits, but for applications having carbon dioxide as refrigerant, brazed plate heat exchangers have hitherto not been strong enough.

Some efforts have been made in order to increase the design pressure of the brazed plate heat exchangers, for example providing an external edge of the heat exchanger with a reinforcing structure.

For decades, it has been known that the design pressure of a brazed heat exchanger increases if the pressed pattern of the heat exchanger plates is "narrow", i.e. exhibits a small distance between rides and grooves of the pressed pattern of the heat exchanger plates.

As well known by persons skilled in the art, in most applications it is not necessary that all flow channels have the same design pressure. In most cases, the refrigerant flow channels require a much higher design pressure. Having flow channels for the media to exchange heat with the refrigerant with a high design pressure is often inevitable, however pointless. On the contrary, it is often detrimental to have flow channels with a high design pressure for this media; with a high design pressure, the pressure drop increases due to the high surface density of contact points between the plates, and the small distance between the plates.

One other problem with the known heat exchangers is that they have the same length of the channels. This is not very efficient seen from a heat transfer point of view since. As an example, the heat transfer rate between e.g. a brine solution to metal is considerably higher than between coolant and metal. It would hence be desired to increase the length of the coolant flow passages while keeping the length of the brine channels constant.

SUMMARY OF THE INVENTION

The present invention solves the above and other problems by a plate heat exchanger for exchanging heat between media, the heat exchanger comprising a number of stacked plates. The plates are provided with a first, large scale pressed pattern comprising ridges and grooves intended to keep first and second pairs of stacked plates on a distance from one another, such that flow channels for a first medium is formed in spaces between said plate pairs. Moreover, contact points are provided between the plate pairs in points where the large scale pressed pattern of neighboring plate pairs contact one another. The plates of each plate pair are kept on a distance from one another by a small-scale pressed pattern comprising ridges and grooves.

The large-scale ridges R and grooves G may be arranged as elongate ridges and grooves running obliquely over the width of the heat exchanger plates, wherein the ridges and grooves of adjacent plate pairs cross one another when the plate pairs are stacked onto one another.

In another embodiment, the large-scale ridges and grooves may be arranged in a herringbone pattern, wherein apexes of the herringbone pattern of adjacent plates of adjacent plate pairs point in reverse directions.

In order to come to a compact and strong heat exchanger, the heat exchanger plates may be brazed to one another.

BRIEF DESCRIPTION OF THE DRAWINGS

In the following, the invention will be described with reference to the appended drawings, wherein.

DESCRIPTION OF EMBODIMENTS

Figure 1:
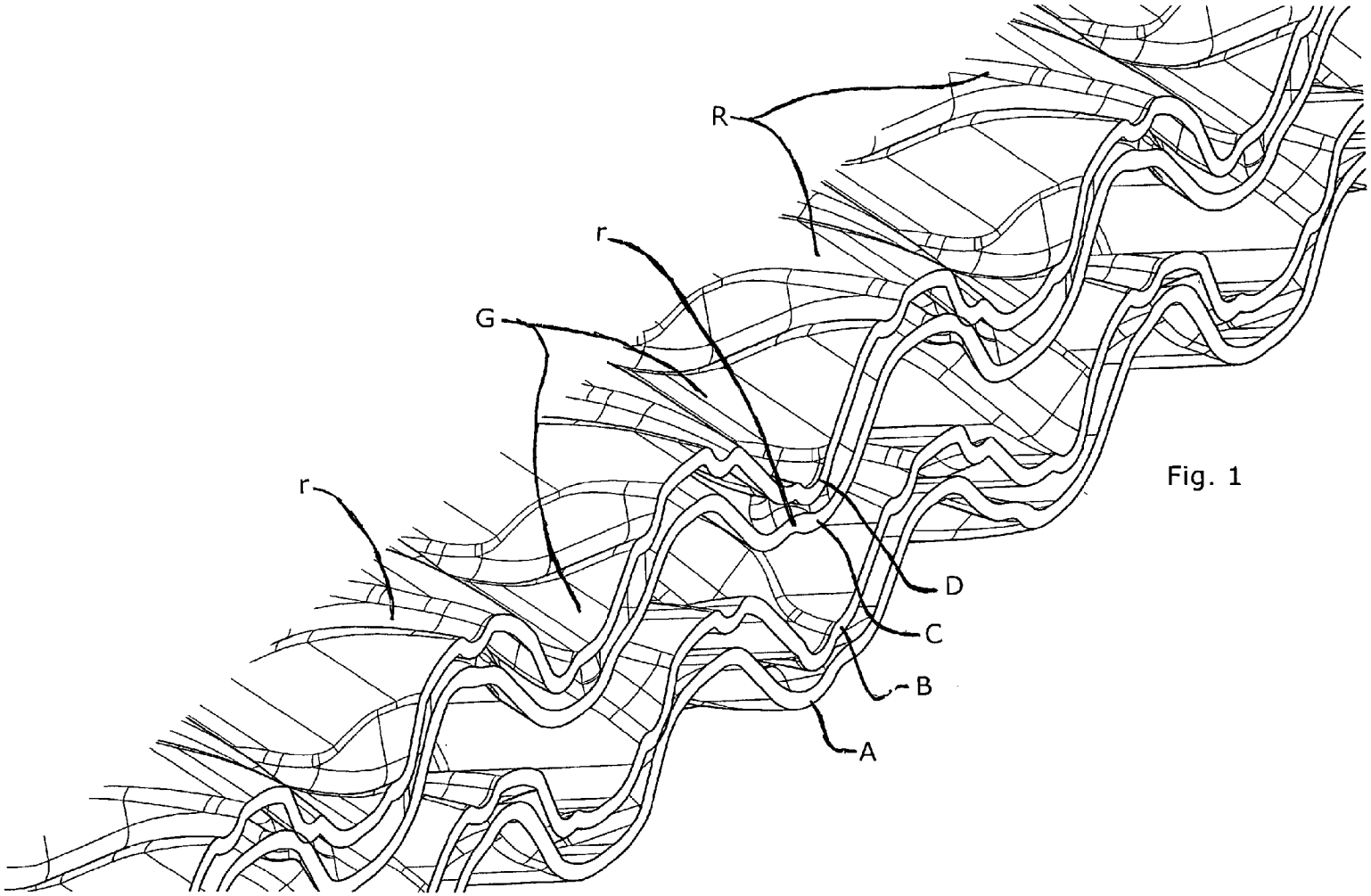
FIG. 1 is a sectioned perspective view of four heat exchanger plates comprised in the heat exchanger according to the invention and FIG. 2 is a section view showing a randomly chosen section of the four plates of FIG. 1.
Figure 2:
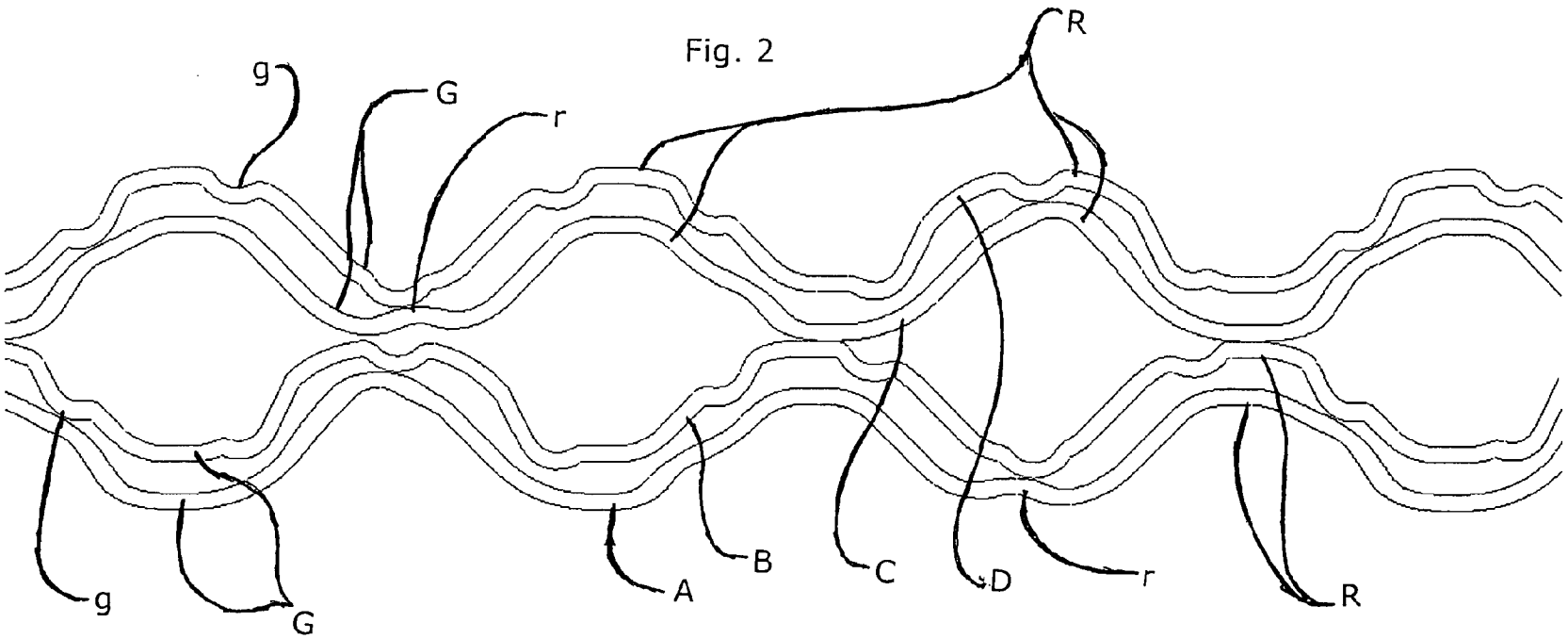

In FIG. 1, four heat exchanger plates A, B, C and D are shown in a sectioned perspective view. All four plates are provided with a large scale pressed pattern of ridges R and depressions D, running obliquely across the width of a heat exchanger plate (not shown).

The heat exchanger plates are arranged such that a heat exchanger pair comprising the heat exchanger plates A and B is arranged such that the ridges R and grooves G of the large scale pressed pattern run parallel and synchronously with each other. The plates C and D form another pair of heat exchanger plates wherein the ridges R and grooves G run parallel and synchronous with each other. In the stack of heat exchanger plates forming the heat exchanger, the two pairs of plates A, B and C, D, respectively, are placed such that the ridges R and grooves G of the plates B and C cross to form contact points between the plates B and C. The contact points between the ridges R and grooves G will keep the plates on a distance from one another, hence forming a flow channel BC.

All heat exchanger plates A, B C and D are also provided with a small-scale pressed pattern comprising ridges r and grooves g. The ridges and grooves r, g are integrated in the large scale pattern comprising the ridges R and grooves G, and arranged such that the grooves g of the heat exchanger plate D cross ridges r of the heat exchanger plate C, in order to form contact points between the plates C and D, such that the heat exchanger plates are kept on a distance from one another under formation of narrow flow channels CD, while the contact points provide a connection, which, after a brazing operation to be explained later, keep the plates bonded to one another. The heat exchanger plates A and B are also provided with small-scale grooves g and small-scale ridges r, such that the plates A and B are kept on a distance from another under formation of flow channels AB.

In order to allow selective fluid flow through the flow channels AB, BC and CD, provided by the large scale and small scale pressed patterns, areas (not shown) around port openings (not shown) are provided at different heights in a way well known by persons skilled in the art.

The heat exchanger plates of the heat exchanger are also provided with edge portions designed to co-act with edge portions of adjacent plates to form a sealed circumferential edge portion, also in a way well known by persons skilled in the art.

In the shown embodiment, four different kinds of heat exchanger plates are used. If the port openings have the same size, it is possible to use two types of heat exchanger plates, but by using four plates, it is possible to have port openings having two different sizes.

Using two different port sizes is beneficial, since the he flow areas of the flow channels BC formed by the large-scale pressed pattern comprising the grooves G and the ridges R is substantially larger then the flow area of the flow channels AB and CD formed by the small scale pressed pattern comprising the grooves g and the ridges r; having different flow areas of the flow channels and the same size of the port openings will either render the port opening too small or the port opening too large. In a preferred embodiment of the invention, the port openings communicating with the flow channels defined by the small-scale grooves and ridges are smaller than the port openings defined by the large-scale grooves and ridges.

As could be understood from the above description, the flow channels AB and CD, formed by the small scale pressed pattern with the ridges r and the grooves g will meander in a way defined by the large scale pressed pattern. This means that the effective length of these flow channels will be larger as compared to the efficient length of the flow channels formed by the large scale pressed pattern comprising the ridges and grooves R and G, respectively.

This is very beneficial when it comes to one of the intended uses of the heat exchanger according to the invention, namely heat exchange between carbon dioxide and a brine solution. As well known by persons skilled in the art, the heat transfer rate between metal and carbon dioxide is significantly lower than between brine solution and metal. By increasing the efficient length of the heat flow channels for the carbon dioxide, the heat exchange capability of the heat exchanger will increase significantly, without increasing the actual length of the heat exchanger.

As well known by persons skilled in the art of heat exchangers, this is very beneficial in some cases. The heat transfer rate is often lower for the media travelling through the small scale flow channel.

One further benefit of the heat exchanger according to the present invention is that it is possible to have varying burst pressure capabilities of the large channels BC and the small channels AB and CD. This can be achieved by arranging the ridges r and the grooves r close to one another; if the ridges r and grooves g are located close to one another, more contact points between the plates will be formed; hence, the burst pressure will increase.

Above, the ridges R, r and the grooves G, g have been described as elongate ridges and grooves crossing one another. In other embodiments of the invention, however, the ridges and grooves R, r, G, g, respectively, may be in the form of "dimples", i.e. smoothed conical depressions and projections. However, it is crucial that there are no "negative" press angles in the pressed pattern; after the pressing of the press pattern, the pressing tool must release the pressed plate.

The plates A, B, C and D of a heat exchanger according to the present invention are preferably brazed to one another, but it is also possible to design the edge portions (not shown) and the port areas to host gaskets to form a gasket sealed heat exchanger.

The invention claimed is:

1. A plate heat exchanger for exchanging heat between media, the heat exchanger comprising a number of stacked plates, the plates being provided with a large scale pressed pattern comprising ridges R and grooves G that keep pairs of stacked plates a distance from one another, such that flow channels for a first medium are formed in spaces between said pairs of stacked plates, and to provide contact points between said pairs of stacked plates at points where the large scale pressed pattern of neighboring plate pairs contact one another, wherein the plates of each of said pairs of stacked plates are kept a distance from one another by a small-scale pressed pattern comprising ridges r and grooves g, wherein within the plates of each of said plate pairs of stacked plates, the large scale pressed pattern comprising ridges R in each of the plates of said plate pairs of stacked plates align with each other and the large scale pressed pattern comprising grooves G in each of the plates of said plate pairs of the stacked plates align with each other.

2. The plate heat exchanger of claim 1, wherein the large-scale ridges R and grooves G are arranged as elongate ridges and grooves running obliquely over the heat exchanger plates, wherein the ridges R and grooves G of adjacent said pairs of stacked plates touch cross one another when said pairs of stacked plates are stacked onto one another.

3. The plate heat exchanger of claim 1, wherein the large-scale ridges R and grooves G are arranged in a herringbone pattern, wherein apexes of the herringbone pattern of adjacent plates of adjacent said pairs of stacked plates point in reverse directions.

4. The heat exchanger of claim 1, wherein the heat exchanger plates are brazed to one another.

* * * * *